United States Patent [19]

Junginger et al.

[11] Patent Number: 4,603,675

[45] Date of Patent: Aug. 5, 1986

[54] SUPERVISORY AND MONITORING SYSTEM FOR AN ELECTRONICALLY CONTROLLED AUTOMOTIVE FUEL CONTROLLER, AND METHOD

[75] Inventors: Erich Junginger, Stuttgart; Eberhard Schnaibel, Hemmingen; Erich Schneider, Kirchheim, all of Fed. Rep. of Germany

[73] Assignee: Robert Bosch GmbH, Stuttgart, Fed. Rep. of Germany

[21] Appl. No.: 760,126

[22] Filed: Jul. 29, 1985

[30] Foreign Application Priority Data

Aug. 16, 1984 [DE] Fed. Rep. of Germany ..... 3430077
Mar. 21, 1985 [DE] Fed. Rep. of Germany ..... 3510173

[51] Int. Cl.[4] ..... F02D 43/00
[52] U.S. Cl. ..... 123/478; 123/352
[58] Field of Search ..... 123/478, 352, 350, 480, 123/445, 446, 486, 494, 472, 399, 491

[56] References Cited

U.S. PATENT DOCUMENTS

| | | | |
|---|---|---|---|
| 4,426,980 | 1/1984 | Eirele et al. | 123/478 |
| 4,438,496 | 3/1984 | Ohie | 123/478 |
| 4,470,396 | 1/1984 | Hasumi et al. | 123/478 |
| 4,473,052 | 9/1984 | Kamiyama et al. | 123/478 |
| 4,524,745 | 6/1985 | Tominari et al. | 123/478 |
| 4,552,116 | 11/1985 | Kuroiwa et al. | 123/478 |

*Primary Examiner*—Raymond A. Nelli

*Attorney, Agent, or Firm*—Frishauf, Holtz, Goodman & Woodward

[57] ABSTRACT

To sense proper operation of a servo control loop including a fuel control pedal (1) which operates a command control transducer (2), e.g. a potentiometer coupled thereto, to provide a command signal to a controller (3) which energizes an amplifier (4) operating a positioning motor (5) which, in turn, changes the position of a fuel control element (7, 207), the instantaneous position of which is fed back to the controller by a position control transducer (6), a signal processing and logic circuit (9, 13) is provided which has the actual fuel supply signal applied thereto. The actual fuel supply signal is evaluated with respect to predetermined limits, for example at a "rest" or OFF position of the fuel control element. This condition can be sensed, for example, based on operating data of the engine, e.g. when a brake light switch is operated, the engine operates above a certain speed, or the vehicle operates at a certain speed, or the like. Additionally, a position sensing switch (8) coupled to the control pedal (1) can be monitored by determining if the output signal from the command transducer is within a limited range when the switch is in a position indicating that the pedal is at, or close to, OFF or "rest" position. By evaluating the actual signal from the respective transducers at predetermined positions of the elements to which they are coupled, e.g. the fuel control element (7, 207) being against an idle or rest stop (16, 216) or the fuel control pedal (1) being at "rest" position, limit switches, particularly in the engine compartment, can be eliminated.

20 Claims, 2 Drawing Figures

SUPERVISORY AND MONITORING SYSTEM FOR AN ELECTRONICALLY CONTROLLED AUTOMOTIVE FUEL CONTROLLER, AND METHOD

Reference to related application, the disclosure of which is hereby incorporated by reference, assigned to the assignee of the present application:

U.S. Ser. No. 760,124, filed July 29, 1985, JUNGINGER et al claiming priority German Applns. Nos. P 34 30 076.7 of Aug. 16, 1984 and P 35 10 176.8 of Mar. 21, 1985.

German Patent Disclosure Document DE-OS No. 31 09 638, to which European Patent Application No. 0 060 326 corrresponds.

The present invention relates to automotive internal combustion engines (ICEs) which may be of the Otto motor type, or of the Diesel engine type, and more particularly to electronic control of the fuel controller by including a servo mechanism between the operator-controlled fuel pedal and the actual fuel control element of the ICE, for example the throttle in the induction pipe of an Otto engine, or the fuel pump control lever or rod of the fuel injection unit for a Diesel engine.

BACKGROUND

It has previously been proposed—see the referenced German Patent Disclosure Document No. DE-OS 31 09 638, to which European Patent Application No. 0 060 325 corresponds—to provide an electronic control system, in form of a servo motor system, for electronic control of fuel being supplied to the ICE as the function of deflection of an operator pedal. Monitoring and control systems for such an electronic servo system are also known. In one such arrangement, as described in the referenced German Patent Publication, a potentiometer which forms an operator pedal position transducer, and coupled to the operator pedal, provides a command signal to a controller which receives from the potentiometer coupled to the throttle an actual signal value. The controller forms a difference or error signal which is applied, via an amplifier or power stage, to a positioning motor, coupled to the throttle, until the error signal becomes zero or null. This servo system, thus, electronically replaces the usual, previously used and quite customary throttle position change mechanism which, ordinarily, is mechanical, for example, by means of a Bowden cable, a linkage, or the like. The overall system, which may be termed an "electronic fuel controller" or "electronic fuel pedal" has the advantage that it is a simple matter to introduce modifying parameters into the electrical system which changes the throttle; this permits accurat and simple control of idle speed and/or control of dynamics of operation of a vehicle, for example upon rapid changes in acceleration, which can easily be carried out by electrical signals, being used to modify the control signals applied to the positioning motor, and entirely independently of position of the operator pedal.

A particularly important feature to be considered in an electronic operator pedal is the operating reliability thereof. Any electronic system which becomes complex will have a substantial number of components; as the number of components rises, the possibility of error or malfunction likewise increases. It is particularly important to consider malfunction or error in the operation of the position transducer, both of the transducer coupled to the operator pedal, as well as to the actual fuel control element, for example the throttle. Further, the drive, or positioning or servo motor which positions the throttle has to be carefully considered, since, by mechanical malfunction, wear and tear, contamination or dirt, errors and non-linear performance may result. It is known to associate the pedal and/or the fuel controller with limit switches at respective limiting positions, for example at idle or no-load and full-load or fully depressed pedal position, corresponding to fully open throttle, or maximum deflection of a fuel injection pump control element. By comparing signals from limit switches, it is possible to obtain logic conditions which may be permitted or are indicate of impossible or prohibited conditions, and thereby, if a prohibited condition is sensed, provide an error or malfunction recognition output.

THE INVENTION

It is an object to provide a monitoring and supervisory system which not only supervises the positioning transducer of an electronic fuel control system, but which does not require limit switches and which additionally is responsive to erroneous or faulty conditions within the servo control loop of the electronic fuel control system. Limit switches, themselves, are subject to possible malfunction and, thus, in accordance with an object of the invention, they are to be eliminated from the supervisory and control system.

Briefly, a signal processing and logic circuit is provided which is coupled to receive the actual fuel supply signal. The processing and logic circuit includes limiting means, for example threshold circuits, which evaluate the characteristic of the actual fuel supply signal with respect to predetermined limites or thresholds, and provide an output when at least one of the predetermined limits is passed. If the limit is an upper limit, passing the limit means exceeding the limit or threshold; if the limit is a lower one, it means passing the limit in a downward direction, or falling below the lower limit.

In accordance with a feature of the invention, the processing and logic circuit tests the signal with respect to predetermined upper and lower limits under the condition that the throttle is in a predetermined position, for example against a lower or idle stop, held there, for example, by a spring, and when the servo motor is deenergized. An error signal will then be formed, and, if the actual value exceeds or falls below a predetermined threshold limit, an indication of malfunction may be present.

In accordance with another feature of the invention, a filter is provided which is coupled to the error signal and forms a filtered value based on the dynamic behavior of the error signal. The filtered value is then compared with the predetermined limit or threshold and, if the predetermined limit or threshold is exceeded, the error or malfunction indication may again be provided.

The system has the advantage that the positioning element or servo motor for the fuel control element is automatically tested for assuming a predetermined fixed quiescent position without, however, requiring a limit switch therefor.

The behavior of the error signal provides indication of the drive applied to the fuel control element by the servo motor, and permits direct evaluation if malfunction should be present. The reliability of supervision is increased by providing a logic which tests for malfunction which does not lead to a control difference or error signal. Such a malfunction may arise, for example, if the position transducer is twisted with respect to its mechanical drive, or if electrical shunts, sneak paths, or other spurious circuits occur, for example by penetration of dirt, moisture, salt-laden humidity or the like, to the transducers, and, by modifying the output signal, provide an erroneous indication of the actual position of the fuel control element.

In accordance with a feature of the invention, testing or monitoring the system is particularly simple if the test is carried out while the vehicle is operating at a higher speed, and the engine at a higher speed, and while the vehicle is being braked. Under those conditions, the operator-controlled pedal is in its OFF position, that is, is unloaded, so that a defined mechanical stop or test point is available. This particular operating condition—braking while the vehicle is moving and the engine is operating at an above-idle speed—arises frequently during the operation of the vehicle. Thus, test cycles can be carried out frequently, and, typically, during operation of the vehicle in coasting or engine-braking mode, that is, when drive power is being transmitted from the wheels to the drive train, rather than from the drive train to the wheels, in effect simulating pushing of the vehicle. Such a condition may occur, for example, during coasting to a stop, downhill operation of the vehicle, or the like.

DRAWINGS

FIG. 1 is a schematic block diagram of the system in accordance with the present invention, which is integrated into a known positioning servo loop of a throttle of an internal combustion engine (not shown); and FIG. 2 is a fragmentary view, illustrating application of the system to a Diesel engine fuel controller.

DETAILED DESCRIPTION

Figures 1, 2:
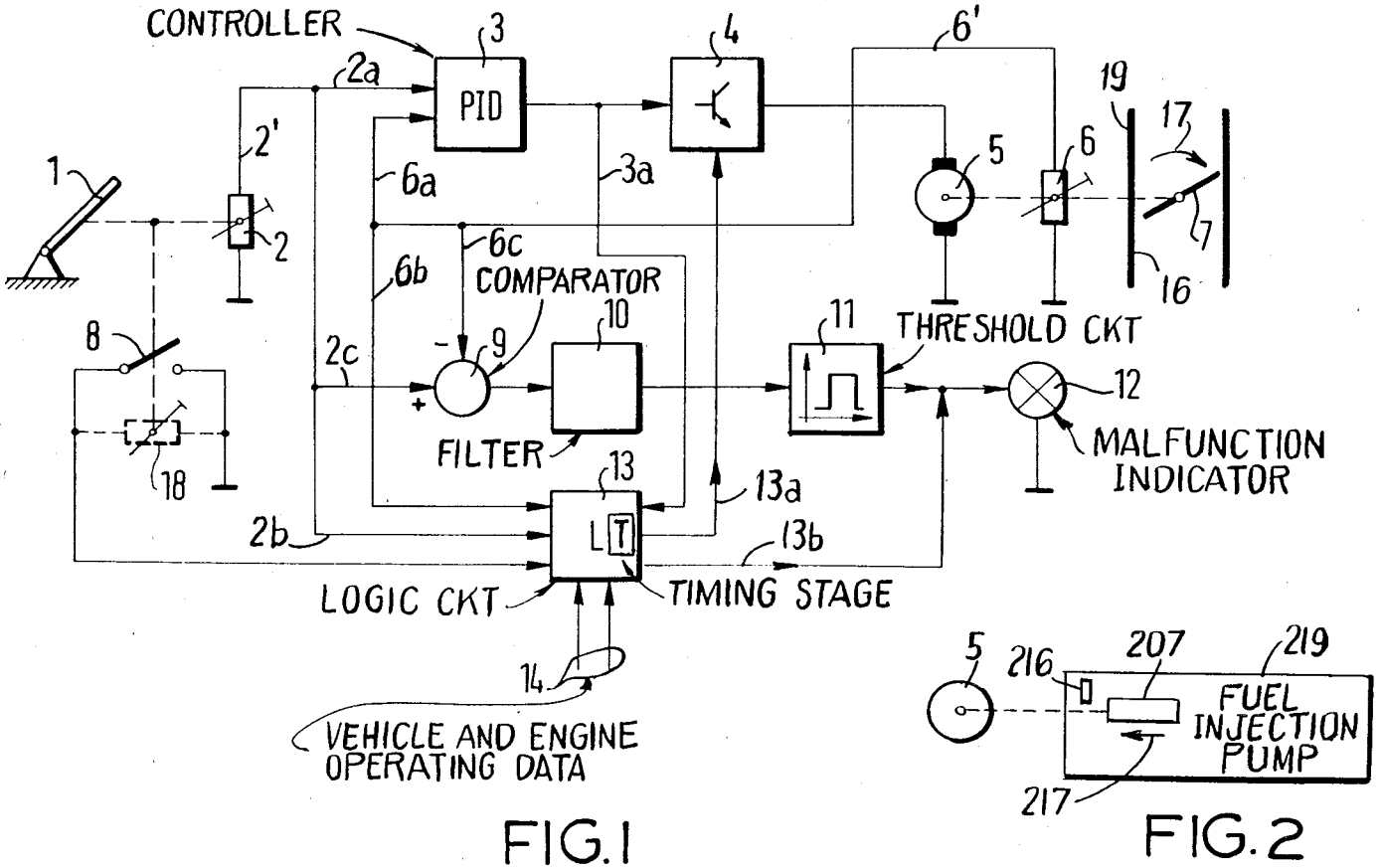

An operator-controlled pedal 1, forming an operator-controllable controller, is coupled to a command control transducer 2, typically a potentiometer, which provides an output signal representative of deflection of the pedal 1. The pedal 1 is additionally coupled to a pedal switch 8 which changes state when the pedal 1 is deflected from a zero or rest or OFF position. The switch 8 may, selectively, open or close upon deflection of the pedal 1. In the position shown, the switch is normally open when the pedal is in its OFF position, and closes upon depression of the pedal although, of course, the reverse operation is also possible. The pedal position transducer is formed as a potentiometer, the resistance of which changes in proportion to the deflection angle of the pedal 1 from a rest position. For some systems, the switch 18 may be replaced by a similar positioning transducer 18 in the form of a potentiometer. The resistance of the potentiometer 2 provides a command signal for a controller 3 which is coupled to the transducer 2. The command signal is applied to a controller 3, typically a proportional-integral-differential controller, which provides an output signal to a power or output stage 4 for a positioning element in the form of a servo motor 5. The servo motor 5 is mechanically coupled to the throttle 7 located within the induction pipe 19 of the vehicle. (not shown). The positioning motor 5 is securely rotatably coupled to the throttle 7. Additionally, and likewise securely coupled to the throttle 7 is a fuel control element position transducer 6, in form of a potentiometer, which may be similar to the potentiometer 2 coupled to the fuel control pedal 1. The resistance of the potentiometer 6, forming a transducer, provides an output value which is an actual fuel supply signal, appearing at line 6', and representative of the actual position of the throttle 7. The signal from the command transducer 2, at line 2', is coupled by a branch **2*a* to the controller 3. The signal from the actual position transducer 6, available at line 6', is coupled by a branch 6*a* to the controller 3**. The control loop, thus, is closed, and is a standard control loop, well known in the servo control art, and need not be explained in detail any further, since it is standard control technology.

The controller 3, as shown in FIG. 1, is a proportional-integral-differential controller (PID) which forms a difference signal between the signals at branches **2*a* and 6*a* and provides a control difference to the power or driver stage 4**.

The monitoring system in accordance with the invention may be used with different types of controllers as well, for example switching-type controllers which consider only the sign of the control difference and for that period of time as the instantaneous or transient response signal of the control loop indicates a decreasing control difference or error signal. The invention, thus, is not limited to the specific example of the control loop which is illustrated.

A difference forming or comparator circuit 9 likewise receives the command signal from the transducer 2 over a branch **2*c*, as well as the actual transduced value from the transducer 6 over the branch 6*c*, to form a control difference signal. This control difference or error signal is applied to a filter 10. The filter 10 determines the dynamic behavior of the control loop, by filtering the control difference or error signal, and thereby is able to provide a quasi-stationary signal to a threshold circuit 11. The threshold level, set at a predetermined level, of the threshold circuit 11 is exceeded if the control difference remains continuously for a predetermined time period, or if the control difference changes as a result of typical errors which can occur in the system, and result in changes of the control difference dynamics of the signal from the comparison or difference forming circuit 9 as filters in filter 10. The output signal of the threshold circuit 11, if the threshold level is exceeded, will provide a malfunction signal, which can be applied to a malfunction indicator 12** within the vehicle, for example a warning light to warn the operator that the fuel control system is not functioning properly.

The system also permits recognition of malfunction or control errors which do not have a remanent control difference as a result, and, to do so, a logic circuit 13 is provided.

The logic circuit 13 receives the output signal from the fuel controller switch 8. Alternatively, it may receive the output signal from a potentiometer 18, or, if both the switch 8 and the potentiometer 18 are used, a definite output signal from the switch 8 when the pedal 1 is moved away from the OFF or idle position and, additionally, a variable signal depending on the deflection of the pedal 1. For operation of this type, the switch 8, then, preferably is a normally closed switch, which opens when the pedal is depressed.

The logic circuit 13, additionally, receives data representative of vehicle and engine operation from inputs, schematically shown by arrows 14. The actual position signal derived from transducer 6 is applied to the circuit 13 over branch line **6*b*. The command signal is applied from transducer 2 over branch line 2*b*. Further, the logic circuit 13 receives the output from the controller 3 over a branch 3***a*.

The vehicle data 14 include signals which indicate:

operation of the brake of the vehicle—for example by being coupled to the brake light or brake signaling switch;

vehicle speed above a predetermined speed level;

engine speed above a predetermined speed level.

When the three given conditions—or other conditions, or at least brake operation and one of the speed signals, are satisfied, and, further, if the switch 8 is in a position indicating OFF or rest position of the pedal 1—or if the potentiometer 18 provides a similar signal—logic 13 provides a control signal on line 13*a* to the power amplifier to deenergize the servo motor 5. The servo motor 5 is of the type that, upon being deenergized, it can spin freely. A spring force, schematically shown by arrow 17, for example a spiral spring coupled to the throttle 7, causes the throttle 7 to close against a minimum or "closed" stop 16, which will likewise turn the transducer 6 to its minimum position providing a minimum or "closed" output signal—provided it is functioning properly.

Operation

Logic circuit 13 compares the minimum value of signal 6' from the transducer 6 with predetermined limits set within the logic circuit, and can thus determine if the drive shaft of the throttle 17 should have been twisted, the throttle 17 is loose on the drive shaft, or if the throttle 17 should be jammed in a non-closed position. Upon detection of a signal at line 6*b* which is outside of upper or lower limits, an error signal is provided on output line 13*b* which, again, is applied to the malfunction indicator 12.

The logic circuit 13 further includes a timing circuit or timing stage T. The timing stage determines if the positioning value of the controller 3 exceeds a predetermined extreme value for a duration beyond a predetermined time interval. If that is the case, the malfunction indicator 12, likewise, is operated. Simultaneously, the power output stage 4 is deenergized by the logic 3, or coupled to a pulse generator which applies the output from the logic 3 in interrupted pulses to the power output stage 4. This arrangement prevents overloading of the power stage 4 and of the motor 5 and, further, permits placing the throttle in a position which enables the vehicle to operate under "limp home" conditions.

Pulsing of the output stage 4, and hence pulsing of the motor 5, can be carried out with a repetition frequency which is so selected that the throttle, based on its own inertia, as well as the inertia of the coupled parts formed by potentiometer 6 and the rotor of the motor 5, will assume a quiescent state which corresponds to the selected pulse repetition rate.

The logic circuit 13 further tests the operability of the command transducer 2 by providing a check if the switch 8 changes state when the transducer 2 provides a command signal which is above a predetermined minimum command threshold and below a second maximum command threshold. A preferred minimum command threshold is about 15% of maximum command value, and the maximum command threshold is, preferably, approximately 25% of the maximum command value. If the condition exists that the switch 8 changes state between 15% to 25% of the command value possible on line 2', the logic circuit 13 determines proper operation, and no malfunction indication is applied on the malfunction output line 13*b*.

If the switch 8 is replaced by a potentiometer, or is used in addition to a potentiometer, logic circuit 13 can be used to compare the difference in signals derived from the transducer 2 and from the potentiometer 18 in any position of the pedal 1, and up to a predetermined maximum or the maximum limit value. If the difference in signals derived from the transducer 2 and the potentiometer 18 exceeds a predetermined maximum value, logic 13 provides a malfunction output signal at line 13*b*, to operate the malfunction indicator 12. The pedal 1 and the transducer 2, as well as the pedal 1 and the transducer 2, as well as the pedal 1 and the switch 8 and/or the comparison potentiometer 18, thus can readily indicate errors which may arise due to malfunction of mechanical coupling between the pedal 1 and the transducer 2, for example due to loosening of a coupling element on a shaft, twist of a shaft, or the like.

The logic circuit 13 can, additionally, carry out a further test regarding plausibility of the OFF or quiescent or rest position of the pedal 1, by comparing the command value derived from the transducer 2 with a threshold level which is a minimum threshold, but only when the condition of operation of the brake also pertains, and the switch 8 has changed state indicating that the pedal 1 is in the OFF or rest position, for example the switch 8 has opened, or, respectively, the potentiometer 18 provides a minimum or "OFF" or "pedal at rest" output signal which is below a threshold level indicative of the pedal being at rest position.

The system is readily applicable not only to an Otto-type engine, but also to a Diesel engine; as schematically shown in the fragmentary diagram of FIG. 2, the throttle 7 is replaced by a fuel pump injection control rod 207, forming part of the fuel injection pump, urged by a spring shown schematically by force arrow 217 against a minimum stop 216. The control rod 207 which, of course, may also be a rotatable control lever, is positioned by the motor 5, as well known in servo systems for fuel injection controllers.

Various changes and modifications may be made, and features described in connection with any one of the embodiments may be used with any of the others, within the scope of the inventive concept.

A suitable controller 3

| | | |
|---|---|---|
| is: | LM 2902 op. Amp. made by National Semiconductor | may be substituted by log. circuit 13 and Software |
| | A suitable comparator 9 | |
| is: | LM 2901 Comparator made by National Semiconductor | |
| | A suitable filter 10 | |
| is: | Lowpass Filter having a filtering frequency or filtering dynamics | |
| of: | 50/150 ms | |
| | A suitable logic circuit 13 | |
| is: | μC 8051 made by Intel and ADC 0809 made by Analog Devices | |

The threshold levels in the threshold circuits can be set either digitally, for example by counting signals to predetermined numbers, or by analog threshold circuits.

The various control functions can readily be obtained by software, that is, by suitable control of microprocessor elements within the respective components. Likewise, the timing stage T can be formed as a counter, counting clock pulses, inherently available in microprocessors.

We claim:

1. In an electronic control system for an automotive internal combustion engine (ICE) having an electronically controllable fuel control element (7, 19; 207) for the ICE, an operator controllable controller (1);

a command control transducer (2) coupled to the operator controllable controller (1) and providing a transduced command signal (2');

a positioning motor(4,5) coupled to the fuel supply control element (7, 207) for positioning thereof;

a fuel position transducer (6) coupled to the fuel control element (7, 207) and providing an actual fuel supply signal (6'); and a servo control loop including a servo controller (3) coupled to receive as inputs the command signal and the actual fuel supply signal, and providing a control output coupled to the positioning motor (5) for positioning of the fuel control element, the improvement comprising a supervisory arrangement for supervising and monitoring the operation of said servo control loop and at least one of: said fuel control element, said command control transducer, said positioning motor, said fuel position transducer, and said operator controllable controller, comprising a signal processing and logic circuit means (9, 10, 13) coupled (6*b*, 6*c*) to receive the actual fuel supply signal (6') and processing said signal, said circuit means including limit means evaluating a characteristic of said actual fuel supply signal with respect to predetermined limits and providing an output when at least one of said predetermined limits is passed.

2. Arrangement according to claim 1, including a limit stop (16, 216) for said fuel control element (7, 207), and means (17, 217) for urging said fuel control element against the limit stop upon deenergization of the positioning motor (5);

and wherein the signal processing and logic circuit means (13) evaluates the level of said actual fuel supply signal when the motor (5) is deenergized, and provides said output if a predetermined limit of the level of the signal is being passed, the signal level forming said predetermined characteristic.

3. Arrangement according to claim 1, wherein the signal processing and logic circuit means includes comparator means (9) comparing the transduced command signal and the actual fuel supply signal and providing a deviation signal;

and wherein the signal processing and logic circuit means further includes a filter (10) connected to and receiving said deviation signal, and comparing the thus filtered deviation signal with a predetermined threshold level, and providing said output when the predetermined threshold level is passed.

4. Arrangement according to claim 1, wherein the signal processing and logic circuit means (9, 10, 13) includes a timing stage (T) and the predetermined characteristic includes time duration and a signal level in excess of the predetermined limit, and providing said output if the predetermined limit is exceeded for said time duration.

5. Arrangement according to claim 4, wherein the output is connected to control the positioning motor (4, 5) for reduced energization thereof with respect to signals applied thereto from the servo controller (3).

6. Arrangement according to claim 1, wherein the automotive ICE is installed in a vehicle, and signaling means (14) provide output signals representative of:

operation of a vehicle brake;

vehicle speed in excess of a predetermined value; and engine speed over a predetermined value;

and wherein the signal processing and logic circuit means is coupled to receive signals from the signaling means (14) and operative to process the actual fuel supply signal with respect to said limit means upon conjunctive occurrence of signals from said signaling means.

7. Arrangement according to claim 1, wherein a switch (8) is coupled to the operator controllable controller, and changing state when the operator controllable controller is close to or at a "rest" or OFF position;

and wherein the signal processing and logic circuit means (13) is additionally connected to and receives said transduced command signal (2') and an output from the switch (8) when the switch has changed state, indicating that the operator controlled controller is at said "rest" or OFF position;

and the signal processing and logic circuit means (13) processes the switch signal and the transduced command signal (2') with respect to said limit means and evaluating if the transduced command signal (2') is above a minimum threshold limit and below a maximum threshold limit and, thus within a predetermined command threshold window range, and provides said output if the range is passed in either exceeding or fall-below direction.

8. Arrangement according to claim 7, wherein the lower threshold limit is about 15% of maximum possible transduced command signal, and the upper threshold limit is about 25% of maximum transduced command signal;

and wherein the switch (8) changes state at about 20% of maximum possible deflection of the operator controllable controller (1).

9. Arrangement according to claim 1, further comprising a position monitoring transducer (18) coupled to the operator controllable controller (1) and providing output signals representative of deflection of said operator controllable controller (1);

wherein the signal processing and logic circuit means (13) is coupled to receive said transduced command signal and the output signals from the position monitoring transducer, and includes a comparator, comparing the transduced command signal with the output signal from the position monitoring transducer and the limit means evaluate differences between said output signal from the positioning monitoring transducer and the transduced command signal and providing the output signal from the logic circuit means (13) if the difference between the compared signal exceeds the predetermined limit.

10. Arrangement according to claim 1, wherein the signal processing and logic circuit means (13) is coupled to receive the transduced command signal (2');

a switch (8) is provided, coupled to the operator controllable controller (1) and providing an output signal upon transition of the operator controllable controller from a "rest" or an OFF position to operated position;

the ICE is installed in a vehicle and signaling means (14) are provided, coupled to the signal processing and logic circuit means (13) and providing a brake operating signal;

and wherein the signal processing and logic circuit means evaluates the transduced command signal (2') with respect to said predetermined limit upon conjunctive condition of: switch output signal indicating that operator controllable controller (1) is in its "rest" or OFF position; and the signaling means operation of the brake of the vehicle, the signal processing and logic circuit means providing said output if the predetermined limit of the transduced command signal under the conjunctive conditions is exceeded.

11. Arrangement according to claim 1, further including a malfunction indicator (12) coupled to receive the outputs from the signal processing and logic circuit means (9, 10, 13).

12. Arrangement according to claim 1, wherein the signal processing and logic circuit means (13) is coupled to the positioning motor (5) and provides a "limp home control signal" to the motor if an output from the signal processing and logic circuit means indicative of malfunction is obtained.

13. Arrangement according to claim 1, wherein the fuel control element (7, 19) comprises the throttle of an Otto-type engine, forming said ICE.

14. Arrangement according to claim 1, wherein the fuel control element (207) comprises a fuel injection pump controller (207) for a Diesel engine, forming said ICE.

15. In an electronic control system for an automotive internal combustion engine (ICE) having an electronically controllable fuel control element (7, 19; 207) for the ICE, an operator controllable controller (1);

a command control transducer (2) coupled to the operator controllable controller (1) and providing a transduced command signal (2');

a positioning motor(4,5) coupled to the fuel supply control element (7, 207) for positioning thereof;

a fuel position transducer (6) coupled to the fuel control element (7, 207) and providing an actual fuel supply signal (6'); and a servo control loop including a servo controller (3) coupled to receive as inputs the command signal and the actual fuel supply signal, and providing a control output coupled to the positioning motor (5) for positioning of the fuel control element, a method of supervising and monitoring operation of said servo control loop, and at least one of:

said fuel control element, said command control transducer, said positioning motor, said fuel position transducer, and said operator controllable controller said method comprising analyzing the actual fuel supply signal (6') with respect to a predetermined characteristic, and comparing said predetermined characteristic with respect to predetermined limits;

and providing a "malfunction" output signal if the predetermined limits are passed.

16. Method according to claim 15, wherein the step of evaluating said signal with respect to the predetermined characteristic comprises comparing said actual fuel supply signal with the transduced command signal, and filtering a resulting deviation signal;

and the step of comparing the evaluated signal comprises comparing the deviation signal with respect to a predetermined threshold limit.

17. Method according to claim 15, wherein the step of evaluating a characteristic of said actual fuel supply signal comprises evaluating the level of the signal at a predetermined position of said fuel control element (7, 207) with respect to said predetermined limits.

18. Method according to claim 15, including the step of determining when said fuel control element (7, 207) is at a "rest" or an OFF position;

and evaluating said actual fuel supply signal under the condition of said fuel control element at said "rest" or OFF position.

19. Method according to claim 15, further including the step of sensing when said operator controllable controller (1) is at a predetermined position within a deflection range thereof;

and including the step of evaluating the transduced command signal with respect to at least one preset limit at, respectively, a higher and lower limit bracketing said position, and further including the step of providing said malfunction output signal if said at least one limit is passed.

20. Method according to claim 15, wherein the system is installed in a vehicle, and including the steps of deriving signals representative of:

operation of a brake of the vehicle;

operation of the vehicle at a speed in excess of a predetermined speed; and operation of the ICE of the vehicle at a speed in excess of a predetermined speed;

determining the conjunctive condition of at least two of said operating conditions;

and wherein said step of evaluating the actual fuel supply signal is carried out upon presence of said at least two conditions.

* * * * *